United States Patent [19]

Kato et al.

[11] Patent Number: 5,053,301

[45] Date of Patent: Oct. 1, 1991

[54] ELECTROPHOTOGRAPHIC LITHOGRAPHIC PRINTING PLATE PRECURSOR

[75] Inventors: Eiichi Kato; Kazuo Ishii, both of Shizuoka, Japan

[73] Assignee: Fuji Photo Film Co., Ltd., Kanagawa, Japan

[21] Appl. No.: 322,965

[22] Filed: Mar. 14, 1989

[30] Foreign Application Priority Data

Mar. 14, 1988 [JP] Japan ..... 63-58256
Apr. 13, 1988 [JP] Japan ..... 63-88917

[51] Int. Cl.[5] ..... G03G 13/26
[52] U.S. Cl. ..... 430/49; 430/87; 430/96
[58] Field of Search ..... 430/49, 87, 96

[56] References Cited

U.S. PATENT DOCUMENTS 4,788,118 11/1988 Takaoka et al. ..... 430/49
4,880,716 11/1989 Kato et al. ..... 430/49

*Primary Examiner*—John Goodrow
*Attorney, Agent, or Firm*—Sughrue, Mion, Zinn, Macpeak & Seas

[57] ABSTRACT

A lithographic printing plate precursor excellent in oil-desensitivity, whereby an original is faithfully reproduced without occurrence of overall or spotted stains as an offset master is provided, which comprises an electrically conductive support and at least one photoconductive layer, provided thereon, containing photoconductive zinc oxide and a binder resin, in which said photoconductive layer contains hydrophilic resin grains having an average grain diameter of same as or smaller than the maximum grain diameter of said photoconductive zinc oxide grains.

17 Claims, No Drawings

ELECTROPHOTOGRAPHIC LITHOGRAPHIC PRINTING PLATE PRECURSOR

BACKGROUND OF THE INVENTION

1. Field of the Invention

This invention relates to an electrophotographic lithographic printing plate precursor made by an electrophotographic system and more particularly, it is concerned with an improvement in a photoconductive layer forming composition for the lithographic printing plate precursor.

2. Description of the Prior Art

A number of offset masters for directly producing printing plates have hitherto been proposed and some of them have already been put into practical use. Widely employed among them is a system in which a photoreceptor comprising a conductive support having provided thereon a photoconductive layer mainly comprising photoconductive particles, for example, of zinc oxide and a resin binder is subjected to an ordinary elecrophotographic processing to form a highly lipophilic toner image on the surface of the photoreceptor, followed by treating the surface with an oil-desensitizing solution referred to as an etching solution to selectively render non-image areas hydrophilic and thus obtain an offset printing plate.

Requirements of offset masters for obtaining satisfactory prints include: (1) an original should be reproduced faithfully on the photoreceptor; (2) the surface of the photoreceptor has affinity with an oil-desensitizing solution so as to render non-image areas sufficiently hydrophilic, but, at the same time, has resistance to solubilization; and (3) a photoconductive layer having an image formed thereon is not released during printing and is well receptive to dampening water so that the non-image areas retain the hydrophilic properties sufficiently to be free from stains even upon printing a large number of prints.

It is known that these properties are affected by the ratio of zinc oxide to a resin binder in the photoconductive layer. For example, if the ratio of a binder resin to zinc oxide particles is decreased, oil-desensitivity of the surface of the photoconductive layer is increased to reduce background stains, but, on the other hand, the internal cohesion of the photoconductive layer per se is weakened, resulting in reduction of printing durability due to insufficient mechanical strength. If the ratio of a binder resin to zinc oxide particles is increased, on the other hand, printing durability is improved, but background staining becomes conspicuous. It is a matter of course that the background staining is a phenomenon associated with the degree of oil-desensitization achieved and it has been made apparent that the oil-desensitization of the photoconductive layer surface depends on not only the binder resin/zinc oxide ratio in the photoconductive layer, but also the kind of the binder resin used to a great extent.

For particular use as an offset master, occurrence of background stains due to insufficient oil-desensitivity presents a serious problem. In order to solve this problem, various resins for binding zinc oxide have been proposed, including resins of $\overline{M}w$ $1.8--10\times10^{-4}$ and Tg 10°-80° C. obtained by copolymerizing (meth)acrylate monomers and other monomers in the presence of fumaric acid in combination with copolymers of (meth-)acrylate monomers and other monomers than fumaric acid, as disclosed in Japanese Patent Publication No. 31011/1975; terpolymers each containing a (meth)acrylic acid ester unit having a substituent having carboxylic acid group at least 7 atoms distant from the ester linkage, as disclosed in Japanese Patent Laid-Open Publication No. 54027/1978; tetra- or pentamers each containing an acrylic acid unit and hydroxyethyl (meth)acrylate unit, as disclosed in Japanese Patent Laid-Open Publication Nos. 20735/1979 and 202544/1982; terpolymers each containing a (meth)acrylic acid ester unit having an alkyl group having 6 to 12 carbon atoms as a substituent and a vinyl monomer containing carboxylic acid group, as disclosed in Japanese Patent Laid-Open Publication No. 68046/1983; and the like. These resins function to improve the oil-desensitivity of photoconductive layers.

Nevertheless, evaluation of such resins as noted above for improving the oil-desensitization indicate that none of them is completely satisfactory in terms of stain resistance, printing durability and the like.

Furthermore, it has hitherto been studied to use resins having functional groups capable of forming hydrophilic groups through decomposition as such a binder resin, for example, those having functional groups capable of forming hydroxyl groups as disclosed in Japanese Patent Laid-Open Publication Nos. 195684/1987, 210475/1987 and 210476/1987 and those having functional groups capable of forming carboxyl groups as disclosed in Japanese Patent Laid-Open Publication No. 212669/1987.

These resins are those which form hydrophilic groups through hydrolysis or hydrogenolysis with an oil-desensitizing solution or dampening water used during printing. When using them as a binder resin for a lithographic printing plate precursor, it is possible to avoid various problems, e.g., deterioration of smoothness, deterioration of electrophotographic properties such as dark charge retention and photosensitivity, etc., which are considered to be caused by strong interaction of the hydrophilic groups and surfaces of photoconductive zinc oxide particles in the case of using resins intrinsically having hydrophilic groups per se, and at the same time, a number of prints with clear image quality and without background stains can be obtained, since the hydrophilic property of non-image areas rendered hydrophilic with an oil-desensitizing solution if further increased by the above described hydrophilic groups formed through decomposition in the resin to make clear the lipophilic property of image areas and the hydrophilic property of non-image areas and to prevent the non-image areas from adhesion of a printing ink during printing.

At the present time, in the electrophotographic lithographic printing, a higher efficiency has been required and in particular, it has been required to increase the speeds of plate making and etching and to obtain a print with a clear image quality, particularly free from background stains, from the start of printing, thus reducing loss of prints.

For such requirements is insufficient the above proposed offset printing plate using the binder resin capable of forming hydrophilic groups through decomposition with respect to the problems of increasing the etching speed and reducing the loss of prints.

SUMMARY OF THE INVENTION

It is an object of the present invention to provide an electrophotographic lithographic printing plate precursor, whereby the disadvantages of the prior art, as described above, can be overcome.

It is another object of the present invention to provide a lithographic printing plate precursor excellent in oil-desensitivity, whereby an original is faithfully reproduced without occurrence of overall or spotted stains as an offset master.

It is a further object of the present invention to provide a lithographic printing plate with a high printing durability, in which the hydrophilic property of non-image areas is sufficiently held to prevent occurrence of background stains even if the steps of from etching to printing are speeded up.

These objects can be attained by an electrophotographic lithographic printing plate precursor comprising a conductive support and at least one photoconductive layer, provided thereon, containing photoconductive zinc oxide and a binder resin, wherein said photoconductive layer contains hydrophilic resin grains having an average grain diameter of same as or smaller than the maximum grain diameter of said photoconductive zinc oxide grains.

DETAILED DESCRIPTION OF THE INVENTION

The hydrophilic resin used in the present invention includes resins such as having a higher order network structure and such that the grain has the above described average grain diameter and the film formed by dissolving the resin grains in a suitable solvent and then coating has a contact angle with distilled water of 50 degrees or less, preferably 30 degrees or less, measured by a goniometer.

In the present invention, it is important that the hydrophilic resin is dispersed in the photoconductive layer in the form of grains whose average grain diameter is same as or smaller than the maximum grain diameter of the photoconductive zinc oxide grains. Such hydrophilic resin grains have such smaller specific areas and less interaction with zinc oxide grain surfaces than those present under molecular state that a lithographic printing plate can be given capable of exhibiting good printing properties because of less deterioration of electrophotographic properties. If there are resin grains having larger grain diameters than zinc oxide grains, the electrophotographic properties are deteriorated and in particular, uniform electrification cannot be obtained, thus resulting in density unevenness in an image area, disappearance of letters or fine lines and background staining in a non-image area in a reproduced image.

Specifically, the resin grains of the present invention have a maximum grain diameter of at most 10 μm, preferably at most 5 μm and an average grain diameter of at most 1.0 μm, preferably at most 0.5 μm. The specific surface areas of the hydrophilic resin grains are increased with the decrease of the grain diameter, resulting in good electrophotographic properties, and the grain size of colloidal grains, i.e., about 0.01 μm or smaller is sufficient. However, very small grains cause the similar troubles to those in the case of molecular dispersion and accordingly a grain size of 0.001 μm or larger is preferable. On the other hand, zinc oxide has generally a grain diameter of 0.05 to 10 μm, preferably 0.1 to 5 μm.

In the present invention, the hydrophilic resin grains or particles are preferably used in a proportion of 0.1 to 5% by weight to 100 parts by weight of photoconductive zinc oxide, since if the hydrophilic resin grains are less than 0.1% by weight, the hydrophilic property of a non-image area does not become sufficient, while if more than 5% by weight, the hydrophilic property of a non-image area is further improved, but electrophotographic properties and reproduced images are deteriorated.

As the hydrophilic resin of the present invention, optionally having a higher order network structure, there can favorably be used any of synthetic and natural hydrophilic resins, for example, described in P. Molyneax "Water-Soluble Synthetic Polymers: Properties and Behavior" Vol. I and Vol. II, CRC Press Inc. (1982); C. A. Finch "Chemistry and Technology of Water-Soluble Polymers" Plenam Press (1983); Matao Nakamura "Water-Soluble Polymers [Suiyosei Kobunshi)" Kagaku Kogyo-sha (1973); Kaimen Kagaku Kenkyukai "New Processing and Modifying Technique and Development of Uses of Water-Soluble Polymers Aqueous Dispersion Type Resins" Keiei Kaihatsu Center Shuppan-bu (1982) and Davidson "Water-Soluble Resin" Reinhold (1968).

The synthetic hydrophilic resins include those containing, in the molecular structures, at least one hydrophilic group selected from the group consisting of ether group, ethylene oxide group, —OH, —SH, —COOH, $—SO_2H$, $—SO_3H$, $—PO_3H_2$, —CN, $—CONH_2$, —CHO, $—SO_2R_1$,

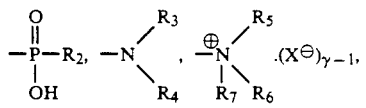

4- to 6-membered heterocyclic ring optionally containing at least one nitrogen atom and organosilane group.

In the above described hydrophilic groups, $R_1$ is a hydrocarbon group containing 1 to 6 carbon atoms, preferably 1 to 4 carbon atoms, which can be substituted, for example, methyl, ethyl, propyl, butyl, 2-chloroethyl, 2-bromoethyl, 2-fluoroethyl, 3-chloropropyl, 3-methoxypropyl, 2-methoxybutyl, benzyl, phenyl, propenyl, methoxymethyl, ethoxymethyl and 2-methoxyethyl groups.

$R_2$ is an aliphatic group containing 1 to 6 carbon atoms, preferably 1 to 4 carbon atoms, which can be substituted, i.e., the similar group to $R_1$ or —OR′ wherein R′ has the same meaning as $R_1$.

$R_3$ and $R_4$ being same or different represent hydrogen atoms or hydrocarbon groups containing 1 to 6 carbon atoms, preferably 1 to 4 carbon atoms, which can be substituted, i.e., have the same meaning as $R_1$. The sum of carbon atoms in $R_3$ and $R_4$ are at most 8, preferably at most 6.

$R_5$, $R_6$ and $R_7$ have the same meanings as $R_3$ and $R_4$, which can be same or different.

$X^{\ominus}$ is an anion, for example, halide ion such as chloride ion, bromide ion or iodide ion, perchlorate ion, tetrafluoroborate ion, hydroxide ion, carboxylate ion such as acetonate ion or propionate ion, sulfonate ion such as methanesulfonate ion, benzenesulfonate ion or p-toluenesulfonate ion, or the like.

$\gamma$ is 1 or 2 and when $\gamma=1$, $R_5$ to $R_7$ contain at least one acidic group such as $—SO_3H$, $—PO_3H_2$ or —COOH as a substituent. A typical example is

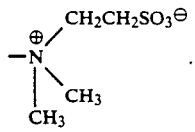

Each of the above described groups, —COOH, $—SO_2H$, $—SO_3H$, $—PO_3H_2$, and

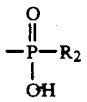

can form a salt with an alkali metal such as lithium, sodium or potassium, alkaline earth metal such as calcium or magnesium, or other metals such as zinc and aluminum, or an organic base such as triethylamine, pyridine, morpholine or piperazine.

Examples of the 4- to 6-membered heterocyclic ring optionally containing at least one nitrogen atom, as described above, are pyridine ring, piperidine ring, pyrrole ring, imidazole ring, pyrazine ring, pyrrolidine ring, pyrroline ring, imidazolidine ring, imidazoline ring, pyrazolidine ring, piperazine ring, morpholine ring, pyrrolidone ring, furan ring, pyrane ring, tetrahydrofuran ring, dioxane ring, dioxolane ring, oxazoline ring, 1,3-oxazine-2-on ring, morpholine-di-on ring, morpholinone ring and the like. These heterocyclic rings can be substituted by substituents, illustrative of which are halogen atoms such as fluorine, chlorine and bromine atoms; hydrocarbon groups containing 1 to 8 carbon atoms, in particular, alkyl groups containing 1 to 3 carbon atoms, which can be substituted, such as methyl, ethyl, propyl, butyl, 2-chloroethyl, 2-bromoethyl, 2-hydroxyethyl, 2-cyanoethyl, 2-methoxyethyl, 2-ethoxyethyl, 2-butoxyethyl, 2-carboxyethyl, carboxymethyl, 3-sulfopropyl, 4-sulfobutyl, 2-methoxycarbonylethyl, 2-ethoxycarbonylethyl, 2-methanesulfonylethyl, benzyl, carboxybenzyl, carboxymethylbenzyl, phenyl, carboxyphenyl, sulfophenyl, methanesulfonylphenyl, ethanesulfonylphenyl, carboxymethylphenyl, methoxyphenyl, chlorophenyl groups and the like; —OR″ groups wherein R″ represents the above described hydrocarbon groups containing 1 to 8 carbon atoms, which can be substituted and —COOR‴ groups wherein R‴ has the same meaning as R″.

The organosilane group includes, for example, a recurring unit represented by the following general formula (I):

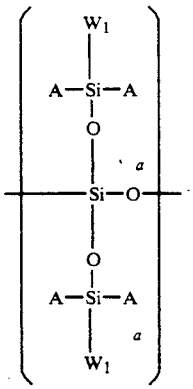

(I)

wherein A is an alkyl group containing 1 to 4 carbon atoms, which can be substituted, such as methyl, ethyl, propyl, butyl, 2-chloroethyl, 2-methoxyethyl, 2-cyanoethyl groups and the like; —OR⁗ group wherein R⁗ has the same meaning as A or —"Z" group wherein Z is trimethylsiloxy, pentamethyldisiloxanyl, heptamethyltrisiloxanyl, nonamethyltetrasiloxanyl, bis(trimethylsiloxy)methylsiloxanyl, tri(trimethylsiloxy) siloxanyl group or the like, and $A_1$ is an alkyl group containing 1 to 6 carbon atoms, which can be substituted, such as methyl, ethyl, propyl, butyl, hexyl, 2-methoxyethyl, 2-ethoxypropyl, 2-cyanoethyl, 2-hydroxyethyl, 2-hydroxy-3-chloropropyl or 2-chloroethyl group, —OR⁗⁗ group wherein R⁗⁗ has the same meaning as R⁗ or a group such that an unsaturated bond selected from the group consisting of vinyl, methacryloxy, acryloxy, methacrylamide, acrylamide, styryl and allyl groups is polymerized and combined with another recurring unit through a divalent hydrocarbon group containing 1 to 6 carbon atoms, and a is an integer of 1 to 10, the sum of a being at least 2.

The hydrophilic resin of the present invention is a homopolymer or copolymer comprising a polymeric component having at least one of the hydrophilic groups in the polymer side chain, the polymeric component being in a proportion of 20 to 100% by weight, preferably 30 to 100% by weight to the resin.

More specifically, this hydrophilic group-containing polymeric component is represented, for example, by the following general formula (II):

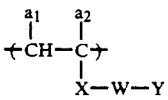

(II)

In the general formula (II), X is —COO—, —OCO—, —O—,

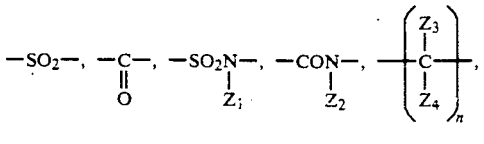

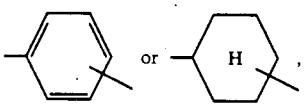

wherein $Z_1$ and $Z_2$ each represent hydrogen atom or hydrocarbon groups containing 1 to 7 carbon atoms such as methyl, ethyl, propyl, butyl, 2-chloroethyl, 2-hydroxyethyl, 3-bromo-2-hydroxypropyl, 2-carboxyethyl, 3-carboxypropyl, 4-carboxybutyl, 3-sulfopropyl, benzyl, sulfobenzyl, methoxybenzyl, carboxybenzyl, phenyl, sulfophenyl, carboxyphenyl, hydroxyphenyl, 2-methoxyethyl, 3-methoxypropyl, 2-methanesulfonylethyl, 2-cyanoethyl, N,N-(dichloroethyl)aminobenzyl, N,N-(dihydroxyethyl)aminobenzyl, chlorobenzyl, methylbenzyl, N,N-(dihydroxyethyl-)aminophenyl, methanesulfonylphenyl, cyanophenyl, dicyanophenyl, acetylphenyl groups and the like, $Z_3$ and $Z_4$ each represent, same or different, hydrogen atom, halogen atoms such as fluorine, chlorine, and bromine atoms and aliphatic groups containing 1 to 4 carbon atoms, in particular, alkyl groups such as methyl, ethyl, propyl and butyl groups, and n represents an integer of 1 to 6. W is a linking group selected from the group consisting of

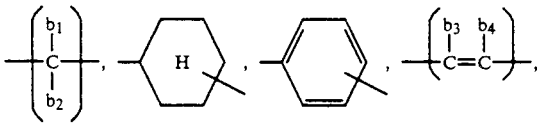

$-COO-$, $-OCO-$, $-O-$, $-S-$, $-SO_2-$, $-\underset{b_5}{N}-$, $-\underset{b_6}{CON}-$, $-SO_2\underset{b_7}{N}-$, $-NHCOO-$, $-NHCONH-$ and $-\underset{O}{\underset{\|}{C}}-$, or a bonding group formed by combination of these linking groups, wherein $b_1$ to $b_4$ represent, same or different, hydrogen atom, halo9en atoms such as fluorine, chlorine and bromine atoms, hydrocarbon groups containing 1 to 7 carbon atoms such as methyl, ethyl, propyl, butyl, 2-chloroethyl, 2-methoxyethyl, 2-methoxycarbonylethyl, benzyl, methoxybenzyl, phenyl, methoxyphenyl, methoxycarbonylphenyl groups and the like and —(W—Y) groups in the general formula (11), and $b_5$ to $b_7$ have the same meaning as $Z_1$ and $Z_2$ described above. Y is the foregoing hydrophilic group, i.e., —OH, SH, —CHO, —CN, —COOH, $-SO_2H$, $-PO_3H_2$, $-SO_2R_1$,

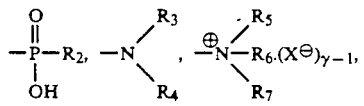

4- to 6-membered heterocyclic rings optionally containing at least one nitrogen atom or organosilane group, wherein $R_1$ to $R_7$ have the same meaning as the foregoing $R_1$ to $R_7$.

In the general formula (II), Y can directly be bonded to the polymer main chain or when X is —O—,

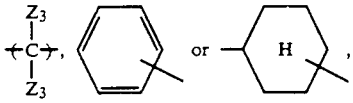

Y can directly be bonded to X.

In the general formula (II), $a_1$ and $a_2$ represent, same or different, hydrogen atom, halogen atoms such as fluorine, chlorine and bromine atoms, —COOH, $-COOR_5$ and $-CH_2COOR_5$ wherein $R_5$ represents a hydrocarbon group containing 1 to 7 carbon atoms, in particular, the same hydrocarbon groups as in $Z_1$ and $Z_2$, and alkyl groups containing 1 to 4 carbon atoms, such as methyl, ethyl, propyl and butyl groups.

Examples of the above described hydrophilic group-containing polymeric component are given below without limiting the scope of the present invention:

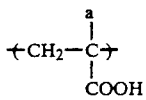

a: —H, $-CH_3$, —Cl, $-CH_2COOH$, $-CH_2COOCH_3$ (1)

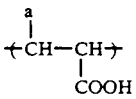

a: $-CH_3$, —COOH, $-CONH_2$, $-CONHC_2H_5$, $-COOCH_3$ (2)

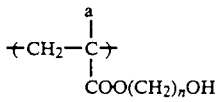

a: $-CH_3$, —H
n: integer of 1 ~ 12 (3)

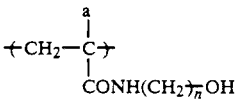

a: —H, $-CH_3$, —Cl
n: integer of 1 ~ 12 (4)

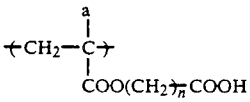

a: —H, $-CH_3$, $-CH_2COOH$, $-CH_2COOCH_3$
n: integer of 1 ~ 12 (5)

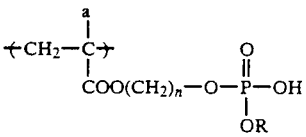

a: —H, $-CH_3$
n: integer of 1 ~ 12
R: —H, $-CH_3$, $-C_2H_5$ (6)

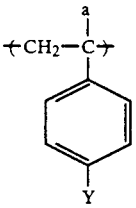

a: —H, $-CH_3$
Y: $-SO_3H$, —COOH, $-CH_2OH$, $-O-\underset{OH}{\overset{O}{P}}-OH$, $-SO_2H$, $-CONH_2$, $-SO_2NH_2$ (7)

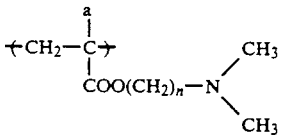

a: —H, $-CH_3$
n: integer of 1 ~ 4 (8)

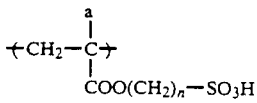

a: —H, $-CH_3$
n: integer of 2 ~ 12 (9)

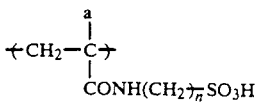

a: —H, $-CH_3$
n: integer of 2 ~ 12 (10)

-continued (11)

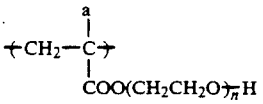

a: —H, —$CH_3$
n: integer of 1 ~ 4

(12)

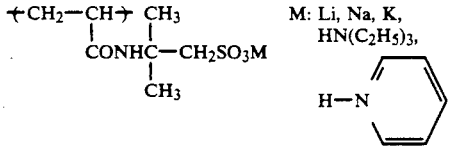

M: Li, Na, K, $HN(C_2H_5)_3$, (13)

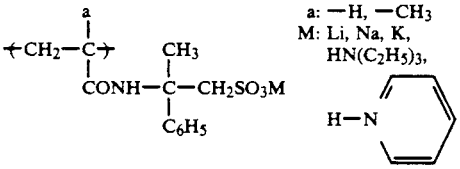

a: —H, —$CH_3$
M: Li, Na, K, $HN(C_2H_5)_3$, (14)

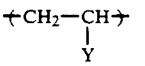

Y: —OH, —$NH_2$ (15)

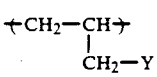

Y: —OH, —$NH_2$ (16)

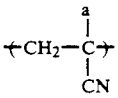

a: —H, —$CH_3$ (17)

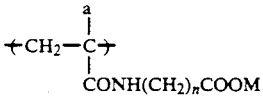

a: —H, —$CH_3$
n: integer of 1 ~ 11
M: Li, Na, K, H—$N(C_2H_5)_3$ (18)

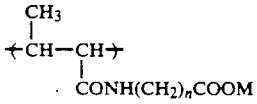

n: integer of 1 ~ 11
M: Li, Na, K, H—$N(C_2H_5)_3$ (19)

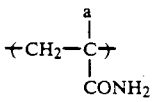

a: —H, —$CH_3$ (20)

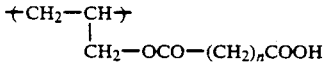

n: integer of 1 ~ 4

(21)

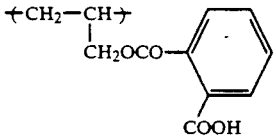

(22)

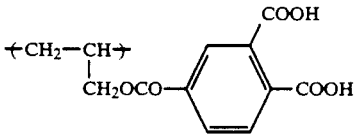

(23)

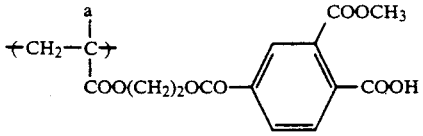

a: —H, —$CH_3$ (24)

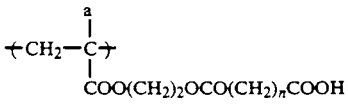

a: —H, —$CH_3$
n: integer of 1 ~ 10

(25)

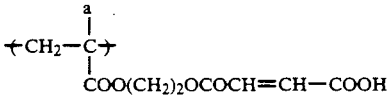

a: —H, —$CH_3$, —$CH_2COOCH_3$ (26)

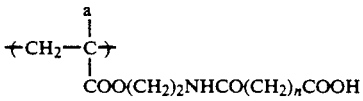

a: —H, —$CH_3$
n: integer of 1 ~ 10

(27)

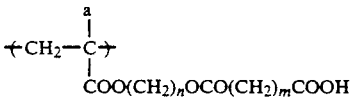

a: —H, —$CH_3$, —$CH_2COOCH_3$
n: integer of 2 ~ 10
m: integer of 1 ~ 10
[(n + m) = 10 or less]

(28)

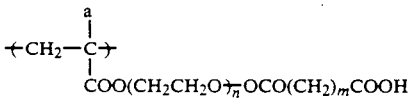

a: —H, —$CH_3$, —Cl
n: integer of 1 ~ 4
m: integer of 1 ~ 4

(29)

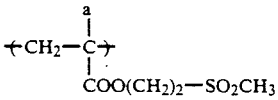

a: —$CH_3$, —H (30)

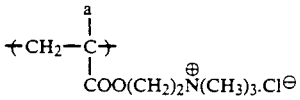

a: —H, —$CH_2$ (31)

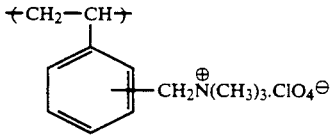

(32)

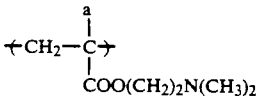

a: —H, —$CH_3$ (33)

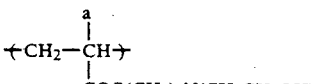

a: —H, —$CH_3$ (34)

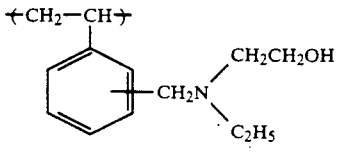

-continued
(35) a: —H, —$CH_3$
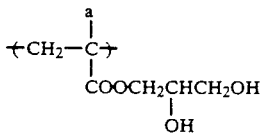
(36) a: —H, —$CH_3$
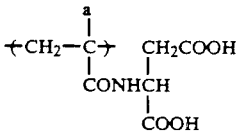
(37) a: —H, —$CH_3$
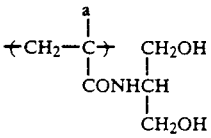
(38) a: —H, —$CH_3$
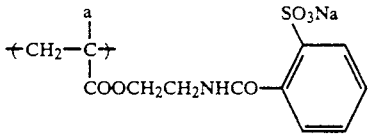
(39)
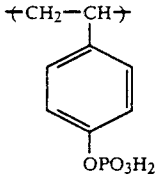
(40)
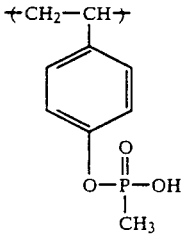
(41)
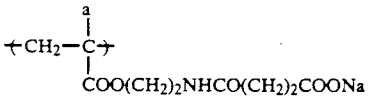
a: —H, —$CH_3$, —$CH_2COOCH_3$
(42)
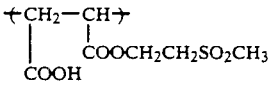
(43)
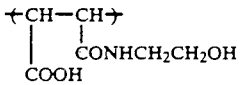
(44)
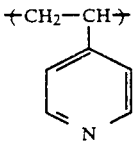
(45)
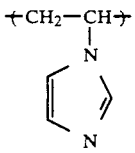
(46)
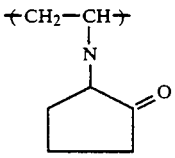
(47) a: —H, —$CH_3$
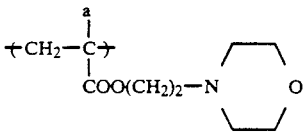
(48)
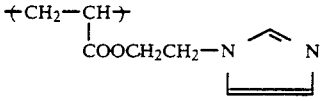
(49)
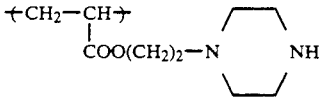
(50)
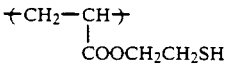
(51)
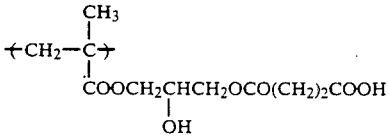
(52)
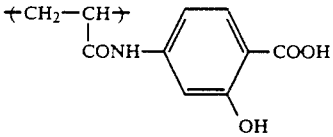
(53) n: integer of 1 ~ 4
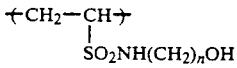
(54)
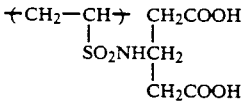
(55)
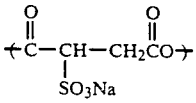
(56)
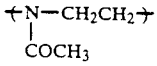

-continued

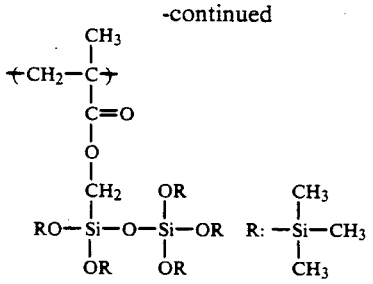

(57)

As other polymeric components which can be copolymerized with the above described hydrophilic group-containing polymeric components, for example, there can be used those represented by the following general formula (III), individually or in combination:

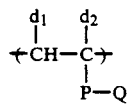

(III)

wherein $d_1$ and $d_2$ have the same meaning as $a_1$ and $a_2$ in the general formula (II), P has the same meaning as X in the general formula (II) and Q is an alkyl group containing 1 to 18 carbon atoms, which can be substituted, such as methyl, ethyl, propyl, butyl, octyl, decyl, dodecyl, tridecyl, hexadecyl, octadecyl, 2-chloroethyl, 3-bromopropyl, 2-methoxycarbonylethyl, 4-methoxycarbonylbutyl, 4-methoxybutyl, 3-chloro-2-methoxypropyl, 3-chloro-2-ethoxycarbonylpropyl, 2-glycidylpropyl, 3-bromo-2-acetyloxypropyl groups and the like; an alicyclic group containing 4 to 12 carbon atoms, which can be substituted, such as cyclopentyl, cyclohexyl, cyclooctyl, chlorocyclohexyl, bromocyclohexyl, 2-cyclohexylethyl, cyclohexylmethyl groups and the like; an alkenyl group containing 2 to 20 carbon atoms, which can be substituted, such as vinyl, allyl groups and the like; an aralkyl group containing 7 to 2 carbon atoms, which can be substituted, such as benzyl, phenethyl, 3-phenylpropyl, ethyl-2-phenylethyl, naphthylmethyl, 2-naphthylethyl, chlorobenzyl, dichlorobenzyl, bromobenzyl, methylbenzyl, dimethylbenzyl, trimethylbenzyl, methoxybenzyl, dimethoxybenzyl, trimethoxybenzyl, methoxycarbonylbenzyl, acetamidebenzyl groups and the like; an aryl group containing 6 to 12 carbon atoms, which can be substituted, such as phenyl tolyl, xylyl mesitylene, naphthyl, chlorophenyl, dichlorophenyl trichlorophenyl, bromophenyl, chlorophenyl, methoxyphenyl, chloro-methyl-phenyl, methylmethoxyphenyl, nitrophenyl, methoxycarbonylphenyl, acetamidephenyl, ethoxyphenyl, chloronaphthyl, ethoxycarbonylnaphthyl, propylphenyl, butylphenyl, chloromethylphenyl, methoxymethylphenyl and N-methylaminosulfonylphenyl groups; 4- to 7-membered heterocyclic rings, i.e., any heterocyclic rings except that foregoing nitrogen atom-containing heterocyclic rings having hydrophilic property, which can be substituted, such as thiophene ring, furan ring, pyrane ring, benzopyrane ring, pyrrole ring, indole ring, quinoline ring, thiazole ring, oxazole ring and benzothiazole ring, the substituent corresponding to alkyl, alkenyl, alicyclic, aralkyl and aryl groups exemplified by the above described Q.

Examples of the natural hydrophilic resin are described in detail in Kaimen Kagaku Kenkyukai "New Processing and Modifying Technique and Development of Uses of Water-Soluble Polymers and Aqueous Dispersion Type Resins", Keiei Kaihatsu Center Shuppan-bu (1981); Matao Nakamura "Water-Soluble Polymers (Suiyosei Kobunshi)" Kagaku Kogyo-sha (1973); R. L. Davidson "Handbook of Water-Soluble Gums and Resins" McGraw-Hill Book Company (1980); and "Encyclopedia of Polymer Science and Engineering" Vol. 3, pp. 69–270, John Wiley and Sons (1985).

Such natural hydrophilic resins include lignin, glucose starch, pullulan, cellulose, alginic acid, dextran, dextrin, gum guar, gum arabic, glycogen, lamiran, lichenin, nigeran and derivatives thereof. As these derivatives, there can be used preferably sulfonated, carboxylated, phosphated, sulfoalkylated, carboxyalkylated, alkylphosphated ones and salts thereof. Two or more natural hydrophilic resins can be used.

In a preferred embodiment of the present invention, the resin grains consist of hydrophilic polymeric components as described above, in which polymer molecule chains are crosslinked to form higher order network structures. Thus, the hydrophilic resin grains are made hardly soluble or insoluble in water, so that the solubility of the resin in water is at most 80% by weight, preferably 50% by weight.

The crosslinking according to the present invention can be carried out by known methods, that is, (1) method comprising crosslinking a polymer containing the hydrophilic component with various crosslinking agents or hardening agents, (2) method comprising polymerizing a monomer corresponding to the hydrophilic polymeric component in the presence of a multifunctional monomer or multifunctional oligomer containing two or more polymerizable functional groups to form a network structure among the molecules and (3) method comprising subjecting polymers containing the hydrophilic polymeric components and reactive groups to polymerization reaction or high molecular reaction and thereby effecting crosslinking.

As the crosslinking agent in the above described method (1), there can be used compounds commonly used as crosslinking agents, for example, described in Shinzo Yamashita and Tosuke Kaneko "Handbook of Crosslinking Agents (Kakyozai Handbook)" published by Taiseisha (1981) and Kobunshi Gakkai Edition "High Molecular Data Handbook -Basis- (Kobunshi Data Handbook -Kisohen-)" published by Baihunkan (1986).

Examples of the crosslinking agent are organosilane compounds such as vinyltrimethoxysilane, vinyltributoxysilane, γ-glycidoxypropyltrimethoxysilane, γ-mercaptopropyltriethoxysilane, γ-aminopropyltriethoxysilane and other silane coupling agents; polyisocyanate compounds such as tolylene diisocyanate, o-tolylene diisocyanate, diphenylmethane diisocyanate, triphenylmethane diisocyanate, polymethylenepolyphenyl isocyanate, hexamethylene diisocyanate, isophorone diisocyanate, high molecular polyisocyanate; polyol compounds such as 1,4-butanediol, polyoxypropylene glycol, polyoxyalkylene glycol, 1,1,1-trimethylolpropane and the like; polyamine compounds such as ethylenediamine, -hydroxypropylated ethylenediamine, phenylenediamine, hexamethylenediamine, N-aminoethylpiperazine, modified aliphatic polyamines and the like; polyepoxy group-containing compounds and epoxy resins, for example, as described in Kakiuchi Hiroshi "New Epoxy Resins (Shin Epoxy Jushi)" published by Shokodo (1985), and Kuniyuki Hashimoto "Epoxy Resins (Epoxy Jushi)" published by Nikkan Kogyo Shinbunsha (1969); melamine resins such as described in Ichiro Miwa and Hideo Matsunaga "Urea and Melamine Resins (Urea-Melamine Jushi)" published by Nikkan Kogyo Shinbunsha (1969); and poly(-meth)acrylate compounds as described in Shin Ogawara, Takeo Saegusa and Toshirobu Higashimura "Oligomers" published by Kodansha (1976) and Eizo Omori "Functional Acrylic Resins" published by Technosystem (1985), for example, polyethylene glycol diacrylate, neopentyl glycol diacrylate, 1,6-hexanediol diacrylate, trimethylolpropane triacrylate, pentaerythritol polyacrylate, bisphenol A-diglycidyl ether diacrylate, oligoester acrylate and methacrylates thereof and the like.

Of the hardening agents used in the above described method (1), natural hydrophilic resins such as gelatin, as the hardening agent, include those described in U.S. Pat. Nos. 3,057,723; 3,671,256; 3,396,029; 4,161,407 and 4,207,109; British Patent No. 1,322,971; Japanese Patent Publication No. 17112/1967; Japanese Patent Laid-Open Publication Nos. 94817/1976, 66841/1981, 207243/1982 and 12132/1984; "The Theory of the Photographic Process" 4th Edition (T. H. James et al.) page 94 and "Polymeric Amines and Ammonium Salts" (E. J. Gehtals et al.) page 21.

Examples of the polymerizable function group of the multifunctional monomer or multifunctional oligomer containing at least two polymerizable functional groups, used in the above described method (2), are:

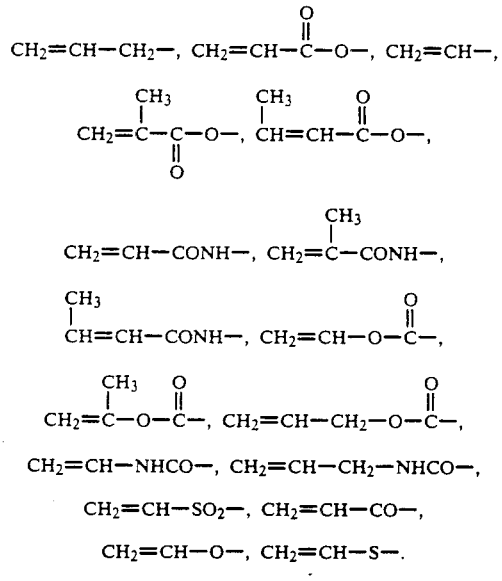

Any of monomers or oligomers containing two or more same or different ones of these polymerizable functional groups can be used in the present invention.

Of these monomers or oligomers, as the monomer or oligomer having two or more same polymerizable functional groups, there can be used styrene derivatives such as divinyl benzene and trivinyl benzene; esters of polyhydric alcohols such as ethylene glycol, diethylene glycol, triethylene glycol, polyethylene glycols Nos. 200, 400 and 600, 1,3-butylene glycol, neopentyl glycol, dipropylene glyclol, polypropylene glycol, trimethylolpropane, trimethylolethane, pentaerythritol and the like or polyhydroxyphenols such as hydroquinone, resorcinol, catechol and derivatives thereof with methacrylic acid, acrylic acid or crotonic acid, vinyl ethers and allyl ethers; vinyl esters of dibasic acids such as malonic acid, succinic acid, glutaric acid, adipic acid, pimelic acid, maleic acid, phthalic acid, itaconic acid and the like, allyl esters, vinylamides and allylamides; and condensates of polyamines such as ethylenediamine, 1,3-propylenediamine, 1,4-butylenediamine and the like with carboxylic acids containing vinyl groups such as methacrylic acid, acrylic acid, crotonic acid, allylacetic acid and the like.

As the monomer or oligomer having two or more different polymerizable functional groups, there can be used, for example, ester derivatives or amide derivatives containing vinyl groups of carboxylic acids containing vinyl group, such as methacrylic acid, acrylic acid, methacryloylacetic acid, acryloylacetic acid, methacryloylpropionic acid, acryloylpropionic acid, itaconyloylacetic acid and itaconyloylpropionic acid, reaction products of carboxylic anhydrides with alcohols or amines such as allyloxycarbonylpropionic acid, allyloxycarbonylacetic acid, 2-allyloxycarbonylbenzoic acid, allylaminocarbonylpropionic acid and the like, for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, 2-(vinyloxycarbonyl)ethyl ester of acrylic acid, N-allylacrylamide, N-allylmethacrylamide, n-allylitaconamide, methcaryloylpropionic acid allylamide and the like; and condensates of amino alcohols such as aminoethnaol, 1-aminopropanol, 1-aminobutanol, 1-aminohexanol, 2-aminobutanol and the like with carboxylic acids containing vinyl groups.

The monomer or oligomer containing two or more polymerizable functional groups of the present invention is generally used in a proportion of at most 10 mole %, preferably at most 5 mole % to all monomers, which is polymerized to form a resin.

In the present invention, there can be used a polymer containing polymerizable double bond groups illustrative of which are the above described similar groups. The polymerization reaction among the polymers can be carried out jointly using the above described polymerizable multifunctional monomer, as well known in the art.

The crosslinking of polymers by reacting reactive groups among the polymers and forming chemical bonds according to the foregoing method (3) can be carried out in the similar manner to the ordinary reactions of organic low molecular compounds, for example, as disclosed in Yoshio Iwakura and Keisuke Kurita "Reactive Polymers (Hannosei Kobunshi)" published by Kohdansha (1977) and Ryohei Oda "High Molecular Fine Chemical (Kobunshi Fine Chemical)" published by Kohdansha (1976). Combination of functional groups classified as Group A (hydrophilic polymeric component) and functional groups classified as Group B (polymers comprising components containing reactive groups) in the following Table 1 has well been known for effectively accomplishing the polymer reactions.

TABLE 1

| Group A | Group B |
|---|---|
| $-COOH$, $-PO_3H_2$ | 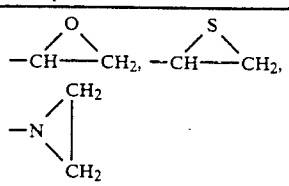 |

TABLE 1-continued

| Group A | Group B |
|---|---|
| —OH, —SH | |
| —$NH_2$ | —COCl, —$SO_2Cl$, cyclic acid anhydride |
| —$SO_2H$ | —N=C=O, —N=C=S, |
| | 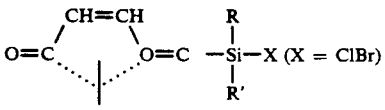 |

As illustrated above, the resin grains of the present invention are polymer grains comprising hydrophilic group-containing polymeric components and having high order crosslinking structures among molecular chains, and for example, hydrogels or highly hygroscopic resins can be used therefor, as described in L. H. Sperling "Interpenetrating Polymer Networks and Related materials" Plenum Press (1981), "Encyclopedia of Polymer Science and Engineering" Vol. 8, pp. 279-340 (1985), J. D. Anclrade "Hydrogels for Medical and Related Application", ACS Symposium Series No. 31, American Chemical Society, Washington D.C. (1976), Eizo Omori "Development Tendency and Use Development of Highly Hygroscopic Resins (Kokyusuisei Jushi no Kaihatsu Doko to sono Yoto Tenkai)" Technoforum Shuppanbu KK (1987), Masahiro Irie "Production and Application of Functional High Molecular Gels (Kinosei Kobunshi Gel no Seizo to Oyo)" published by C. M. C KK (1987), Kenji Tanaka "Petrotech." 10, 25 (1987), "Nikkei New Materials" June 1, 1987, page 57, Jun Taguchi and Kunio Ishii "science and Industry (Kagaku to Kogyo)" 59, 188 (1985), Fusayoshi Masuda "Functioral Materials (Kino Zairyo)" No. 4, p. 36 (1982) and Yoshinori Monma "Chemical Industry (Kagaku Kogyo)" 38, 602 (1987).

Examples of commercially available highly hygroscopic resins are Arasoap (-commercial name-, made by Arakawa Kagaku Kogyo KK), Wondergel (-commercial name-, made by Kao KK), KI Gel (-commercial name-, made by Kurare Isoprene KK), Sanwet (-commercial name-, made by Sanyo Kasei Kogyo KK), Sumika Gel (-commercial name, Sumitomo Kagaku Kogyo KK), Aquakeep (-commercial name-, made by Seitetsu Kagaku Kogyo KK), Lanseal (-commercial name-, made by Nippon Exslan Kogyo KK), Lion Polymer (-commercial name-, made by Lion KK), GP (-commercial name, made by Nippon Gosei Kagaku Kogyo KK), Aqualic (-commercial name-, made by Nippon Shokubai Kagaku Kogyo KK), Aquaprene (-commercial name-, made by Meisei Kagaku Kogyo KK), CLD (-commercial name-, made by Buckeye Cellulose Co.), D. W. A. L. (-commercial name-, Dow Chemical Co.), G. P. C. (-commercial name-, made by Grain Processing Co.), Aqualon (-commercial name-, made by Hercules Co.), Magic Water Gel (-commercial name-, made by Super Adsorbent Co.), Cecagum (-commercial name-, made by CEC Co.), Spon Signus (-commercial name-, made by Kanegafuchi Gosei Kagaku KK), super Rub (-commercial name-, made by Asahi Kasei Kogyo KK), etc.

Production of fine grains or particles of the above described synthetic of natural hydrophilic resin having a specified grain diameter can be carried out by employing a dry or wet method well known in the art, for example, (a) a method comprising directly pulverizing the hydrophilic resin powder by a pulverizing mill of the prior art, such as ball mill, paint shaker, jet mill, etc. and thus obtaining fine grains and (b) a method of obtaining high molecular latex grains. The latter method of obtaining high molecular latex grains can be carried out according to the prior art method for producing latex grains of paints or liquid developers for electrophotography. That is, this method comprises dispersing the hydrophilic resin by the joint use of a dispersing polymer, more specifically previously mixing the hydrophilic resin and dispersion aid polymer or coating polymer, followed by pulverizing, and then dispersing the pulverized mixture in the presence of the dispersing polymer.

For example, these methods are described in "Flowing and Pigment Dispersion of Paints" translated by Kenji Ueki and published by Kyoritsu Shuppan (1971), Solomon "Chemistry of Paints", "Paint and Surface Coating Theory and Practice", Yuji Harasaki "Coating Engineering (Coating Kogaku)" published by Asakura Shoten (1971), Yuji Harasaki "Fundamental Science of Coating (Kiso Kagaku of Coating)" by Maki Shoten (1977) and Japanese Patent Laid-Open Publication Nos. 96954/1987, 115171/1987 and 75651/1987.

Furthermore, the prior art method of obtaining readily latex grains or particles by suspension polymerization or dispersion polymerization can also be used in the present invention, for example, as described in Soichi Muroi "Chemistry of High Molecular Latex (Kobunshi Latex no Kagaku)" published by Kobunshi Kankokai (1970), Taira Okuda and Hiroshi Inagaki "Synthetic Resin Emulsions (Gosei Jushi Emulsion)" published by Kobunshi Kankokai (1978), Soichi Muroi "Introduction to High Molecular Latexes (Kobunshi Latex Nyumon)" published by Kobunsha (1983).

In the present invention, it is preferable to use a method of obtaining high molecular latex grains, whereby resin grains with an average grain diameter of at most 1.0 μm can readily be obtained.

In the electrophotographic lithographic printing plate precursor of the present invention, formation of a photoconductive layer can be carried out by any of methods of dispersing photoconductive zinc oxide in an aqueous system, for example, described in Japanese Patent Publication Nos. 450/1976, 18599/1972 and 41350/1971 and methods of dispersing in a non-aqueous solvent system, for example, described in Japanese Patent Publication No. 31011/1975 and Japanese Patent Laid-Open Publication Nos. 54027/1978, 20735/1979, 202544/1982 and 68046/1983. If water remains in the photoconductive layer, however, the electrophotographic property is deteriorated, and accordingly, the latter methods using a non-aqueous solvent system is preferable. Therefore, in order to adequately disperse the hydrophilic resin latex grains of the present invention in the photoconductive layer dispersed in a non-aqueous system, the latex grains are preferably non-aqueous system latex grains.

When a high molecular latex is synthesized by the dispersion polymerization method in a non-aqueous solvent system, the average grain diameter of the latex grains can readily be adjusted to at most 1 μm while simultaneously obtaining grains of monodisperse system with a very narrow distribution of grain diameters. Such a method is described in, for example, K. E. J. Barrett "Dispersion Polymerization in Organic Media" John Wiley & Sons (1975), Koichiro Murata "Polymer Processings (Kobunshi Kako)" 23, 20 (1974), Tsunetaka Matsumoto and Toyokichi Tange "Journal of Japan Adhesive Association (Nippon Setchaku Kyokaishi)" 9, 183 (1973), Toyokichi Tange "Journal of Japan Adhesive Association" 23, 26 (1987), D. J. Walbridge "NATO. Adv. Study Inst. Ser. E." No. 67, 40 (1983), British Patent Nos. 893,429 and 934,038 and U.S. Pat. Nos. 1,122,397, 3,900,412 and 4,606,989, and Japanese Patent Laid-Open Publication Nos. 179751/1985 and 185963/1985.

As the binder resin of the present invention, there can be used all of known resins, typical of which are vinyl chloride-vinyl acetate copolymers, styrenebutadiene copolymers, styrene-methacrylate copolymers, methacrylate copolymers, acrylate copolymers, vinyl acetate copolymers, polyvinyl butyral, alkyd resins, silicone resins, epoxy resins, epoxyester resins, polyester resins and the like, as described in Takaharu Kurita and Jiro Ishiwataru "High Molecular Materials (Kobunshi)" 17, 278 (1968), Harumi Miyamoto and Hidehiko Takei "Imaging" No. 8, page 9 (1973), Koichi Nakamura "Practical Technique of Binders for Recording Materials (Kiroku Zairyoyo Binder no Jissai Gijutsu)" Section 10, published by C. M. C. Shuppan (1985), D. D. Tatt, S. C. Heidecker "Tappi" 49, No. 10, 439 (1966), E. S. Baltazzi, R. G. Blanckette et al. "Photo Sci. Eng." 16, No. 5, 354 (1972), Nguyen Chank Khe, Isamu Shimizu and Eiichi Inoue "Journal of Electrophotographic Association (Denshi Shashin Gakkaishi)" 18, No. 2, 28 (1980), Japanese Patent Publication No. 31011/1975, Japanese Patent Laid-Open Publication Nos. 54027/1978, 20735/1979, 202544/1982 and 68046/1983.

As the non-aqueous solvent for the non-aqueous system latex, there can be used any of organic solvents having a boiling point of at most 200° C., individually or in combination. Useful examples of the organic solvent are alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing 6 to 14 carbon atoms such as hexane, octane, decane, dodecane, tridecane, cyclohexane and cyclooctane, aromatic hydrocarbons such as benzene, toluene, xylene and chlorobenzene and halogenated hydrocarbons such as methylene chloride, dichloroethane, tetrachloroethane, chloroform, methylchloroform, dichloropropane and trichloroethane.

More specifically, there are given (meth)acrylic copolymers containing at least 30% by weight, based on the total amount of the copolymer, of a monomer represented by the following general formula (IV) as a copolymeric component and homopolymers of the monomer represented by the general formula (IV):

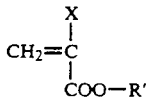

(IV)

wherein X is hydrogen atom, a halogen atom such as chlorine or bromine atom, cyano group, an alkyl group containing 1 to 4 carbon atoms, or —CH2COOR" wherein R" is an alkyl group containing 1 to 6 carbon atoms, which can be substituted, such as methyl, ethyl, propyl, butyl, heptyl, hexyl, 2-methoxyethyl or 2-chloroethyl group, an aralkyl group containing 7 to 12 carbon atoms, which can be substituted, such as benzyl phenethyl, 3-phenylpropyl, 2-phenylpropyl, chlorobenzyl, bromobenzyl, methoxybenzyl or methylbenzyl group, or an aryl group containing 6 to 12 carbon atoms, which can be substituted, such as phenyl, tolyl, xylyl, chlorophenyl dichlorophenyl, methoxyphenyl, bromophenyl or naphthyl group, and R' is an alkyl group containing 1 to 18 carbon atoms, which can be substituted, such as methyl, ethyl, propyl, butyl, pentyl, hexyl, octyl, decyl, dodecyl, tridecyl, tetradecyl, 2-methoxyethyl or 2-ethoxyethyl group, an alkenyl group containing 2 to 18 carbon atoms, which can be substituted, such as vinyl, allyl, isopropenyl, butenyl, hexenyl, heptenyl or octenyl group, an aralkyl group containing 7 to 12 carbon atoms, which can be substituted, such as benzyl, phenethyl, methoxybenzyl, ethoxybenzyl or methylbenzyl group, a cycloalkyl group containing 5 to 8 carbon atoms, which can be substituted, such as cyclopentyl, cyclohexyl or cycloheptyl group, or an aryl group such as phenyl, tolyl, xylyl, mesityl, naphthyl, methoxyphenyl, ethoxyphenyl, chlorophenyl or dichlorophenyl group.

Examples of other monomers to be copolymerized with the monomer represented by the general formula (IV) are vinyl or allyl esters of aliphatic carboxylic acids, such as vinyl acetate, vinyl propionate, vinyl butyrate, allyl acetate, allyl propionate and the like; unsaturated carboxylic acids such as crotonic acid, itaconic acid, maleic acid and fumaric acid, or esters or amides of these unsaturated carboxylic acids; styrene or styrene derivatives such as vinyltoluene and α-methylstyrene; α-olefins and vinyl group-substituted heterocyclic compounds such as N-vinylpyrrolidone, acrylonitrile and methacrylonitrile.

The binder resin used in the present invention has preferably a molecular weight of $10^3$ to $10^6$, more preferably $5\times10^3$ to $5\times10^5$ and a glass transition point of −10° C. to 120° C., more preferably 0° C. to 85° C.

The above described binder resin serves to not only fix photoconductive zinc oxide and the foregoing hydrophilic resin grains in a photoconductive layer, but also combine closely the photoconductive layer with a support. If the quantity of the binder resin is too small, therefore, the fixing and bonding strength is lowered, so that the printing durability as a printing plate is reduced and repeated use of the printing plate is impossible, while if too large, the printing durability and repeated use can be improved, but the electrophotographic property is deteriorated as described above.

In the present invention, therefore, 10 to 60% by weight, preferably 15 to 40% by weight of the above described binder resin is used to 100 parts by weight of photoconductive zinc oxide.

In the present invention, if necessary, various coloring matters or dyes can be used as a spectro sensitizer, illustrative of which are carbonium dyes, diphenylmethane dyes, triphenylmethane dyes, xanthene dyes, phthalein dyes, polymethine dyes such as oxonol dyes, merocyanine dyes, cyanine dyes, rhodacyanine dyes, styryl dyes etc. and phthalocyanine dyes which can contain metals, as described in Harumi Miyamoto and Hidehiko Takei "Imaging" No. 8, page 12 (1973), C. Y. Young et al. "RCA Review" 15, 469 (1954), Kohei Kiyota et al. "Denki Tsushin Gakkai Ronbunshi" J63-C (No. 2), 97 (1980), Yuji Harasaki et al. "Kogyo Kagaku Zasshi" 66, 78 and 188 (1963) and Tadaaki Tani "Nippon Shashin Gakkaishi" 35, 208 (1972).

For example, those using carbonium dyes, triphenylmetahe dyes, xanthene dyes or phthalein dyes are described in Japanese Patent Publication No. 452/1976, Japanese Patent Laid-Open Publication Nos. 90334/1975, 114227/1975, 39130/1978, 82353/1978 and 16456/1982 and U.S. Pat. Nos. 3,052,540 and 4,054,450.

As the polymethine dyes such as oxonol dyes, merocyanine dyes, cyanine dyes and rhodacyanine dyes, there can be used dyes described in F. M. Harmmer "The Cyanine Dyes and Related Compounds" and specifically dyes described in U.S. Pat. Nos. 3,047,384, 3,110,591, 3,121,008, 3,125,447, 3,128,179, 3,132,942 and 3,622,317; British Patent Nos. 1,226,892, 1,309,274 and 1,405,898; and Japanese Patent Publication Nos. 7814/1973 and 18892/1980.

The polymethine dyes capable of spectrally sensitizing near infrared radiations to infrared radiations with longer wavelengths of at least 700 nm are described in Japanese Patent Publication No. 41061/1976; Japanese Patent Laid-Open Publication Nos. 840/1972, 44180/1972, 5034/1974, 45122/1974, 46245/1982, 35141/1981, 157254/1982, 26044/1986 and 27551/1986; U.S. Pat. Nos. 3,619,154 and 4,175,956; and "Research Disclosure" 216, pages 117–118 (1982).

The photoreceptor of the present invention is excellent in that its performance is hardly fluctuated even if it is used jointly with various sensitizing dyes. Furthermore, various additives for electrophotographic light-sensitive layers, such as chemical sensitizers, well known in the art can jointly be used as occasion demands, for example, electron accepting compounds such as benzoquinone, chloranil, acid anhydrides, organic carboxylic acids and the like, described in the foregoing "Imaging" No. 8, page 12 (1973) and polyarylalkane compounds hindered phenol compounds, p-phenylenediamine compounds and the like, described in Hiroshi Komon et al. "Latest Development and Practical Use of Photoconductive Materials and Light-Sensitive Materials (Saikin no Kododenzairyo to Kankotai no Kaihatsu to Jitsuyoka)" Sections 4 to 6, published by Nippon Kagaku Joho Shuppanbu (1986).

The amounts of these additives re not particularly limited, but are generally 0.0001 to 2.0% by weight based on 100 parts by weight of the photoconductive zinc oxide.

The thickness of the photoconductive layer is generally 1 to 100 μm, preferably 10 to 50 μm.

When in a photoreceptor of laminate type consisting of a charge generating layer and charge transporting layer, a photoconductive layer is used as the charge producing layer, the thickness of the charge producing layer is generally 0.01 to 1 μm, preferably 0.05 to 0.5 μm.

The photoconductive layer of the present invention can be provided on a support as well known in the art. Generally, a support for an electrophotographic light-sensitive layer is preferably electroconductive and as the electroconductive support, there can be used, as known in the art, metals or substrates such as papers, plastic sheets, etc. which are made electroconductive by impregnating low resistance materials therein, substrates whose back surface, opposite to the surface to be provided with a light-sensitive layer, is made electroconductive, which is further coated with at least one layer for the purpose of preventing it from curling; the above described support provided with, on the surface thereof, a water proof adhesive layer; the above described support optionally provided with, on the surface layer, one or more pre-coat layer; and papers laminated with plastics which are made electroconductive, for example, by vapor deposition of Al or the like thereon. Examples of the substrates or materials which are electroconductive or made electroconductive are described in Yukio Sakamoto "Electrophotography (Denshi Shashin)" 14 (No. 1), pages 2 to 11 (1975), Hiroyuki Moriga "Introduction to Chemistry of Special Papers (Nyumon Tokushushi no Kagaku)" Kobunshi Kankokai (1975}, M. F. Hoover "J. Macromol. Sci. Chem." A 4 (6), pp. 1327–1417 (1970), etc.

Production of a lithographic printing plate using the electrophotographic lithographic printing plate precursor of the present invention can be carried out in known manner. That is, the electrophotographic lithographic printing plate precursor is electrostatically charged substantially uniformly in a dark place and imagewise exposed to form an electrostatic latent image by an exposing method, for example, by scanning exposure using a semiconductor laser, He-Ne laser, etc., by reflection imagewise exposure using a xenon lamp, tungsten lamp, fluorescent lamp, etc. as a light source or by contact exposure through a transparent positive film. The resulting electrostatic latent image is developed with a toner by any of various known development methods, for example, cascade development, magnetic brush development, powder cloud development, liquid development, etc. Above all, the liquid development method capable of forming a fine image is particularly suitable for making a printing plate. The thus formed toner image can be fixed by a known fixing method, for example, heating fixation, pressure fixation, solvent fixation, etc.

The printing plate having the toner image, formed in this way, is then subjected to a processing for rendering hydrophilic the non image area in conventional manner using the so-called oil-desensitizing solution. The oil-desensitizing solution of this kind include processing solutions containing, as a predominant component, cyanide compounds such as ferrocyanides or ferricyanides, cyanide-free processing solutions containing, as a predominant component, amine cobalt complexes, phytic acid or its derivatives or guanidine derivatives, processing solutions containing, as a predominant component, organic acids or inorganic acids capable of forming chelates with zinc ion, and processing solutions containing water-soluble polymers.

For example, the cyanide compound-containing processing solutions are described in Japanese Patent Publication Nos. 9045/1969 and 39403/1971 and Japanese Patent Laid-Open Publication Nos. 76101/1977, 107889/ and 117201/1979. The phytic acid or its derivatives-containing processing solutions are described in Japanese Patent Laid-Open Publication Nos. 83807/1978, 83805/1978, 102102/1978, 109701/1978, 127003/1978, 2803/1979 and 44901/1979. The metal complex-containing processing solutions are described in Japanese Patent Laid-Open Publication Nos. 104301/1978, 14013/1978 and 18304/1979 and Japanese Patent Publication No. 28404/1968. The inorganic acid- or organic acid-containing processing solutions are described in Japanese Patent Publication Nos. 13702/1964, 10308/1965, 28408/1968 and 26124/1965 and Japanese Patent Laid-Open Publication No. 118501/1976. The guanidine compound-containing processing solutions are described in Japanese Patent Laid- Open Publication No. 111695/1981. The water-soluble polymer-containing processing solutions are described in Japanese Patent Laid-Open Publication Nos. 36402/1974, 126302/1977, 134501/1977, 49506/1978, 59502/1978 and 104302/1978 and Japanese Patent Publication Nos. 9665/1963, 22263/1964, 763/1965 and 2202/1965.

The oil-desensitizing treatment can generally be carried out at a temperature of about 10° C. to about 50° C., preferably from 20° C. to 35° C., for a period of not longer than about 5 minutes.

In any of the above described oil-desensitizing solutions, the zinc oxide in the surface layer as the photoconductive is ionized to be zinc ion which causes a chelation reaction with a compound capable of forming a chelate in the oil-desensitizing solution to form a zinc chelate compound. This is precipitated in the surface layer to render the non-image area hydrophilic.

Thus, the printing plate precursor of the present invention can be converted into a printing plate by the oil-desensitizing processing with an oil-desensitizing solution.

The present invention will now be illustrated in greater detail by way of examples, but it should be understood that the present invention is not limited thereto.

EXAMPLES

Preparation Example 1 of Resin Grains

A mixed solution of 95 g of dodecyl methacrylate, 5 g of acrylic acid and 200 g of toluene was heated to 70° C. while stirring under a nitrogen stream, and 1.5 g of azobis(isobutyronitrile) (referred to as A. I.B.N.) was added thereto and reacted for 8 hours. To this reaction mixture were added 12 g of glycidyl methacrylate, 1 g of t-butylhydroquinone and 0.8 g of N,N-dimethyldodecylamine, followed by allowing the mixture to react at 100° C. for 15 hours (Dispersed Resin (I).

A mixture of 7.5 g (as solid content) of the above described Dispersed Resin I, 50 g of 2-hydroxyethyl methacrylate and 200 g of n-heptane was heated to 65° C. while stirring under a nitrogen stream, and 0.7 g of 2,2-azobis(isovaleronitrile) (referred to as A. I. V. N.) was then added thereto and reacted for 6 hours.

After passage of 20 minutes from the addition of the initiator (A. I. V. N.), the homogeneous solution became slightly opaque, the reaction temperature being raised to 90° C. After cooling, the reaction product was passed through a nylon cloth of 200 mesh to obtain a white dispersion having an average grain diameter of 0.19 μm as a white latex.

Preparation Example 2 of Resin Grains

A mixture of 50 g of acrylonitrile, 8 g of Dispersed Resin I (as solid content) and 200 g of n-hexane was heated to 55° C. while stirring under a nitrogen stream, and 0.5 g of A. I. V. N. was added thereto and reacted for 4 hours, thus obtaining a white dispersion. After cooling, the reaction product was passed through a nylon cloth of 200 mesh. The resulting dispersion was a latex with an average grain diameter of 0.08 μm.

Preparation Example 3 of Resin Grains

Preparation Example 1 was repeated except using a mixture of 50 g of N-vinylpyrrolidone 10 g of Dispersed Resin (as solid content) and 200 g of toluene, thus obtaining a white latex with an average grain size of 0.30 μm.

Preparation Example 4 of Resin Grains

A mixture of 31.5 g of ethylene glycol, 51.8 g of phthalic anhydride, 6.0 g of methacrylic acid, 10 g of trichloroethylene and 0.7 g of p-toluenesulfonic acid was heated and reacted for 6 hours in such a manner that the reaction temperature was raised from 107° C. to 150° C. in 6 hours, while removing water byproduced by the reaction by the Dean-Stark method.

A mixture of 6 g of methacrylic acid, 76 g of chloroform, 11.6 g of ethanol and 5.8 g of Dispersed Resin II obtained by the above described reaction (as solid content) was then refluxed under a nitrogen stream. 0.8 g of A. I. B. N. was then added thereto and reacted for 3 hours to obtain a white dispersion, latex with an average grain diameter of 0.40 μm.

Preparation Example 5 of Resin Grains

Preparation Example 1 was repeated except using a mixture of 50 g of N,N-dimethylaminoethyl methacrylate, 15 g of poly(dodecyl methacrylate) and 300 g of toluene, thus obtaining a white dispersion with an average grain diameter of 0.28 μm.

Preparation Example 6 of Resin Grains

A mixture of 10 g of (2-hydroxyethyl acrylate/methyl methacrylate) copolymer (weight ratio 1/1) powder, 2 g of (dodecyl methacrylate/acrylic acid) copolymer (weight ratio 95/5) and 100 g of toluene was ball milled for 48 hours to obtain a dispersion, i.e. latex with an average grain diameter of 0.38 μm.

Preparation Example 7 of Resin Grains

A mixture of 10 g of (vinyl alcohol/methacrylic acid) copolymer (weight ratio 7/3), 1.8 g of (decyl methacrylate/N,N-dimethylaminoethyl acrylate) copolymer weight ratio 95/5) and 100 g of toluene was ball milled for 56 hours to obtain a dispersion, latex with an average grain diameter of 0.32 μm.

Example 1

A mixture of 200 g of photoconductive zinc oxide, 40 g of (ethyl methacrylate/acrylic acid) copolymer (weight component ratio 97/3, weight average molecular weight 63,000), 1.5 g [as solid content) of the resin grains obtained in Preparation Example 1, 0.06 g of Rose Bengal and 300 g of toluene was ball milled for 2 hours. The thus resulting light-sensitive layer forming dispersion was applied to a paper rendered electrically conductive to give an adhered quantity on dry basis of 25 g/m$^2$ by a wire bar coater, followed by drying at 110° C. for 30 seconds. The thus coated paper was allowed to stand in a dark place at a temperature of 20° C. and a relative humidity of 65% for 24 hours to prepare an electrophotographic light-sensitive material. Observation of the surface layer and sectional layer of the resulting light-sensitive material by an electron microscope taught that the zinc oxide had a maximum grain diameter of about 1 μm and an average grain diameter of about 0.3 to 0.5 μm.

Comparative Example 1

The procedure of Example 1 was repeated except not using 1.5 g (as solid content) of the resin grains obtained in Preparation Example 1 to prepare an electrophotographic light-sensitive material.

These light-sensitive materials were then subjected to evaluation of the electrostatic characteristics and reproduced image quality, in particular, under ambient conditions of 30° C. and 80% RH. Furthermore, when using these light-sensitive materials as a master plate for offset printing, the oil-desensitivity of the photoconductive layer in terms of a contact angle of the photoconductive layer with water after oil-desensitization and the printing performance in terms of a stain resistance and printing durability.

The image quality and printing performance were evaluated using a lithographic printing plate obtained by subjecting the light-sensitive material to exposure and development by means of an automatic plate making machine, ELP 404 V (-commercial name-, made by Fuji Photo Film Co., Ltd.) using a developing agent, ELP-T (-commercial name-, made by Fuji Photo Film Co., Ltd.) to form an image and etching by means of an etching processor using an oil-desensitizing solution, ELP-E (-commercial name-, made by Fuji Photo Film Co., Ltd.). As a printing machine, Hamada Star 800 SX (-commercial name-, made by Hamada Star KK) was used.

The results are shown in Table 2:

TABLE 2

| | Example 1 | Comparative Example 1 |
|---|---|---|
| Electrostatic Characteristics(1) | | |
| Vo (−V) | 580 | 555 |
| DRR (%) | 85 | 88 |
| $E_{1/10}$ (lux · sec) | 12.0 | 11.5 |
| Image Quality(2) | | |
| I: (20° C., 65%) | good | good |
| II: (30° C., 80%) | good | good |
| Contact Angle with Water(3) (degrees) | less than 10° | 40–50° large dispersion |
| Background stain(4) | | |
| I | no | yes |
| II | no | marked |
| Printing Durability(5) | no stain even after 10000 prints | marked background stain from printing start |

The characteristic item described in Table 2 are evaluated as follows:

1) Electrostatic Characteristics

Each of the light-sensitive materials was negative charged to a surface potential Vo (−V: negatively charged) by corona discharge at a voltage of 6 kV for 20 seconds in a dark room at a temperature of 20 ° C. and relative humidity of 65% using a paper analyzer (Paper Analyzer Sp-428 -commercial name-manufacture by Kawaguchi Denki KK) and after allowed to stand for 10 seconds, the surface potential $V_{10}$ was measured. Then, the sample was further allowed to stand in the dark room as it was for 60 seconds to measure the surface potential $V_{70}$, thus obtaining the retention of potential after the dark decay for 60 seconds, i.e., dark decay retention ratio (DRR (%)) represented by $(V_{70}/V_{10})\times 100$ (%). Moreover, the surface of the photoconductive layer was negatively charged to −400 V by corona discharge, then irradiated with visible ray at an illumination of 2.0 lux and the time required for dark decay of the surface potential ($V_{10}$) to 1/10 was measured to evaluate an exposure quantity $E_{1/10}$ (lux.sec).

2) Image quality

Each of the light-sensitive materials was allowed to stand for a whole day and night under the following ambient conditions and a reproduced image was formed thereon using an automatic printing plate making machine KLP-404 V (-commercial name-, made by Fuji Photo Film Co., Ltd., Ltd.) to visually evaluate the fog and image quality: (I) 20° C., 65% RH and (II) 30° C., 80% RH.

3) Contact Angle with Water

Each of the light-sensitive materials was passed once through an etching processor using an oil-desensitizing solution ELP-E (-commercial name-, made by Fuji Photo Film Co., Ltd.) 5 times diluted with distilled water to render the surface of the photoconductive layer oil-desensitized. On the thus oil-desensitized surface was placed a drop of 2 μl of distilled water and the contact angle formed between the surface and water was measured by a goniometer.

4) Background Stain of Print

Each of the light-sensitive materials was processed by an automatic printing plate making machine ELP-404 to form a toner image and subjected to oil-desensitization under the same conditions as in the above described item (3). The resulting printing plate was mounted, as an offset master, on a printing machine, Hamada Star 800 SX (-commercial name- made by Hamada Star KK) and printing was carried out on fine papers to obtain 500 prints. All the prints thus obtained were subjected to visual evaluation of the background stains, which was designated as Background Stain I of the print.

Background Stain II of the print was defined in an analogous manner to Background Stain I as defined above except that the moistening water during printing was 2-fold diluted. Case II corresponds to a printing carried out under severe conditions than Case I.

5) Printing Durability

The printing durability was defined by the number of prints which could be obtained without forming background stains on the non-image areas of the print and meeting with any problem on the image quality of the image areas by printing under the evaluation conditions corresponding to Background Stain II of the above described item 4). The more the prints, the better the printing durability.

As can be seen from Table 2, the light-sensitive material of the present invention exhibited excellent electrostatic characteristics of the photoconductive layer and gave a reproduced image free from background stains and excellent in image quality. This tells that the photoconductive material and binder resin are sufficiently combined and the added hydrophilic resin grains have no bad influences upon the electrostatic characteristics.

When the light-sensitive material of the present invention is used as a master plate for offset printing, the oil-desensitizing processing can well be accomplished by one passage through a processor even with a diluted oil-desensitizing solution and consequently, a non-image area is so rendered hydrophilic that the contact angle of the non-image area with water be smaller than 10° . Thus, it is found by observation of real prints that the printing plate precursor of the present invention can form a clear image and produce more than 10,000 clear prints without background stains.

In Comparative Example 1, on the other hand, the electrophotographic properties (image quality) were good, but in the oil-desensitizing processing as a master plate for offset printing, a non-image area was not sufficiently rendered hydrophilic, so that in real printing, background stains markedly occurred from the beginning in the print.

It will clearly be understood from these considerations that according to only the present invention, there can be obtained an electrophotographic photoreceptor capable of satisfying electrostatic properties as well as printing adaptability.

Examples 2 to 5

The procedure of Example 1 was repeated except using 1.5 g (as solid content) cf each of the resin grains shown in Table 3 instead of the resin grains obtained in Preparation Example 1, thus obtaining each of electrophotographic light-sensitive materials.

These light-sensitive materials were subjected to the similar evaluations to Example 1 to obtain results as shown in Table 3:

TABLE 3

| Example | Hydrophilic Resin Grains | Image Quality | Contact Angle with Water | Number of Printing Durability |
|---|---|---|---|---|
| 2 | Preparation Example 2 | excellent in and II of Table 2 | 12° | more than 10,000 prints free from stains |
| 3 | Preparation Example 3 | excellent in and II of Table 2 | 8° | more than 10,000 prints free from stains |
| 4 | Preparation Example 4 | excellent in and II of Table 2 | 5° or less | more than 10,000 prints free from stains |
| 5 | Preparation Example 5 | excellent in and II of Table 2 | 5° or less | more than 10,000 prints free from stains |

As can be seen from the results of Table 3, the electrophotographic photoreceptor of the present invention has excellent electrophotographic properties and is capable of giving a number of clear prints free from background stain.

Examples 6 to 12

The procedure of Example 1 was repeated except using 1.0 g (as solid content) of each of the resin grains shown in Table 4 instead of the resin grains obtained in Preparation Example 1, thus obtaining each of light-sensitive materials.

These light-sensitive materials were subjected to measurement of the electrostatic characteristics and printing properties in an analogous manner to Example 1, thus obtaining good results. In real printing, more than 10,000 prints wee obtained without occurrence of any background stain.

TABLE 4

| Example | Resin Grains | Average Grain Diameter |
|---|---|---|
| 6 | 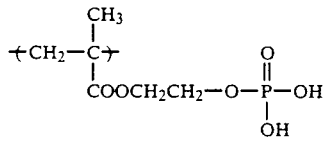 | 0.28 μm |
| 7 | 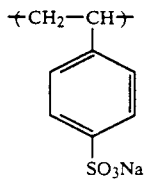 | 0.30 μm |
| 8 | 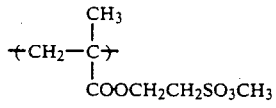 | 0.25 μm |
| 9 | 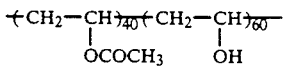 | 0.45 μm |
| 10 | 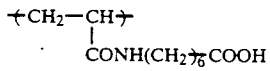 | 0.17 μm |
| 11 | 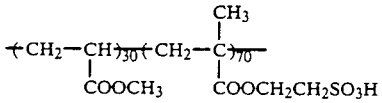 | 0.25 μm |
| 12 | 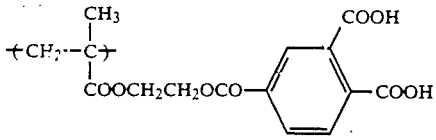 | 0.30 μm |

EXAMPLE 13

A mixed solution of 50 g of vinylbenzenecarboxylic acid and 200 g of methyl cellosolve was heated to 70° C. under a nitrogen stream while stirring, and 1.0 g of A. I. B. N. was added thereto, followed by reacting for 8 hours. After cooling, the reaction mixture was subjected to a reprecipitation treatment in 1.0 l of water-methanol (volume ratio 1/1) to obtain a white powder, which was then dried. The yield was 42 g.

A mixture of 1.8 g of this white powder (polyvinylbenzenecarboxylic acid), 200 g of photoconductive zinc oxide, 40 g of (ethyl methacrylate/acrylic acid) copolymer (weight component ratio 97/3, weight average molecular weight 63,000), 0.3 g of Rose Bengal, 0.2 g of tetrabromophenol blue and 300 g of toluene was dispersed in a ball mill for 2 hours to prepare a light-sensitive coating composition.

The resulting light-sensitive composition was coated onto a sheet of paper having been rendered electrically conductive to give a dry coverage of 25 g/m$^2$ by a wire bar coater, followed by drying at 110° C. for 30 seconds. The thus coated paper was allowed to stand in a dark place at a temperature of 20° C. and a relative humidity of 65% for 24 hours to prepare an electrophotographic light-sensitive material.

Comparative Example 2

A dispersion treatment was carried out for 2 hours in an analogous manner to Example 13 except not using 1.8 g of the resin powder (polyvinylbenzenecarboxylic acid). To the resulting dispersed product was added 1.8 g of the above described resin powder and the mixture was dispersed in a ball mill for 10 minutes to prepare a light-sensitive coating composition. Using the resulting light-sensitive composition, an electrophotographic light-sensitive material was prepared in an analogous manner to Example 13.

These light-sensitive materials were then subjected to evaluation of the film property (surface smoothness) and as in Example 1, evaluation of the electrophotographic properties and printing properties.

TABLE 5

| | Example 13 | Comparative Example 2 |
|---|---|---|
| Smoothness of Photoconductive Layer* (sec/cc) | 105 | 45 |
| Electrostatic Characteristics(1) | | |
| Vo (−V) | 540 | 480 |
| DRR (%) | 86 | 75 |
| $E_{1/10}$ (lux · sec) | 11.4 | 8.5 |
| Image Quality | | |
| I: (20° C., 65%) | good | disappearance of fine lines, letters; blur of solid areas |
| II: (30° C., 80%) | good | no image density Dmax |
| Contact Angle with Water (degrees) | less than 10° | 10–25° large dispersion |
| Background stain | | |
| I | no | yes |
| II | no | marked |
| Printing Durability | no stain even after 10000 prints | occurrence of disapearance of image areas and background stain |

Note: *Smoothness of Photoconductive Layer
The smoothness (sec/cc) was measured by means of a Beck's smoothness tester (manufactured by Kumagaya Riko KK) under an air volume condition of 1 cc.

In Examples of the present invention and Comparative Example, the same resin powder was used but changing the time for dispersing it so that the grain size of the resin powder be different. This difference can be judged by measuring the smoothness of the photoconductive layer, since the presence of coarser or larger grains reduces the value of the smoothness, i.e., renders the surface rough.

In Comparative Example 2, the dispersion time was shorter after the addition of the resin powder, resulting in a reduced smoothness of the photoconductive layer due to the effect of the resin powder added afterward. In the electrostatic characteristics, DRR was lowered and consequently, the apparent $E_{1/10}$ also became smaller.

In a reproduced image, there were a number of disappearances in image areas and blurs of solid areas and this phenomenon further became remarkable under ambient conditions of high temperature and high humidity, thus lowering Dmax, i.e., to less than 0.6.

Evaluation of the printing property as a master plate for offset printing shoed areas free from background stain and areas dotted with marked background stains.

It will clearly be understood from these results that only the light-sensitive material of the present invention, that is, the case where the coexistent resin grains are sufficiently small can give better effects.

Preparation Example 8 of Resin Grains

A mixed solution of 95 g of dodecyl methacrylate, 5 g of acrylic acid and 200 g of toluene was heated to 70° C. while stirring under a nitrogen stream, and 1.5 g of azobis(isobutyronitrile) (referred to as A. I.B.N.) was added thereto and reacted for 8 hours. To this reaction mixture were added 12 g of glycidyl methacrylate, 1 g of t-butylhydroquinone and 0.8 g of N,N-dimethyldodecylamine, followed by allowing the mixture to react at 100° C. for 15 hours (Dispersed Resin I).

A mixture of 7.5 g (as solid content) of the above described Dispersed Resin I, 50 g of 2-hydroxyethyl methacrylate, 1 g of divinyl adipate and 200 g of n-heptane was heated to 65° C. while stirring under a nitrogen stream, and 0.7 g of 2,2-azobis(isovaleronitrile) (referred to as A. I. V. N.) was then added thereto and reacted for 6 hours.

After passage of 20 minutes from the addition of the initiator (A. I. V. N.), the homogeneous solution became slightly opaque, the reaction temperature being raised to 90° C. After cooling, the reaction product was passed through a nylon cloth of 200 mesh to obtain a white dispersion having an average grain diameter of 0.25 μm as a white latex.

Preparation Example 9 of Resin Grains

A mixture of 50 g of acrylonitrile, 8 g of Dispersed Resin I (as solid content), 1.2 g of divinylbenzene and 200 g of n-hexane was heated to 55° C. while stirring under a nitrogen stream, and 0.5 g of A. I. V. N. was added thereto and reacted for 4 hours, thus obtaining a white dispersion. After cooling, the reaction product was passed through a nylon cloth of 200 mesh. The resulting dispersion was a latex with an average grain diameter of 0.20 μm.

Preparation Example 10 of Resin Grains

Preparation Example 8 was repeated except using a mixture of 50 g of N-vinylpyrrolidone, 10 g of Dispersed Resin (as solid content), 1.5 g of ethylene glycol dimethacrylate and 200 g of toluene, thus obtaining a white latex with an average grain size of 0.30 μm.

Preparation Example 11 of Resin Grains

A mixture of 31.5 g of ethylene glycol, 51.8 g of phthalic anhydride, 6.0 g of methacrylic acid, 10 g of trichloroethylene and 0.7 g of p-toluenesulfonic acid was heated and reacted for 6 hours in such a manner that the reaction temperature was raised from 107° C. to 150° C. in 6 hours, while removing water byproduced by the reaction by the Dean-Stark method.

A mixture of 6 g of methacrylic acid,0.05g of 1,6-hexanediol diacrylate, 76 g of chloroform, 11.6 g of ethanol and 5.8 g (as solid content) of Dispersed Resin I was then refluxed under a nitrogen stream. 0.8 g of A. I. B. N. was then added thereto and reacted for hours to obtain a white dispersion, latex with an average grain diameter of 0.45 μm.

Preparation Example 12 of Resin Grains

Preparation Example 8 was repeated except using a mixture of 50 g of N,N-dimethylaminoethyl methacrylate, 0.8 g of triethylene glycol dimethacrylate, 15 g of poly(dodecyl methacrylate) and 300 g of toluene, thus obtaining a white dispersion with an average grain diameter of 0.43 μm.

Preparation Example 13 of Resin Grains

A mixed solution of 50 g of the following Monomer A, 30 g of methyl methacrylate, 17 g of 2-hydroxyethyl methacrylate, 3 g of allyl methacrylate and 300 g of tetrahydrofuran was heated to 80° C. under a nitrogen stream. 1.5 g of A.I.B.N. was added thereto, reacted for 6 hours and then subjected to reprecipitation in n-hexane. A solid product was collected by filtering and dried to obtain 84 g of a powder.

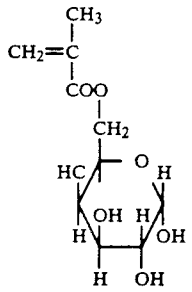

Monomer A

Preparation Example 14 of Resin Grains

A mixture of 50 g of (2-hydroxypropyl methacrylate/ethyl methacrylate) copolymer (weight component ratio 1/3) and 200 g of methyl cellosolve was heated to 40° C. to prepare a solution, to which 1.0 g of 1,6-hexamethylene diisocyanate was added and stirred for 4 hours. The mixture was cooled, subjected to reprecipitation in water and a solid product was then collected by filtration, followed by drying to obtain 35 g of a powder.

Preparation Example 15 of Resin Grains

A mixture of 5 g of 2-methyl-2 oxazoline, 1.0 g of 1,4-tetramethylene-2,2'-bisoxazoline, 0.1 g of boron trifluoride in the form of ether solution and 20 g of acetonitrile was subjected to sealing polymerization at 100° C. for 7 hours. The thus resulting reaction product was subjected to reprecipitation in methanol and a solid product was obtained by filtration, followed by drying to obtain 4.1 g of a powder.

The resin (hydrogel) obtained in this Preparation Example has the following structure:

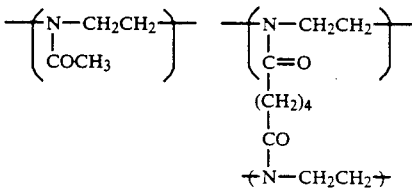

Preparation Example 16 of Resin Grains

A mixed solution of 50 g of 2-methanesulfonylethyl methacrylate, 0.8 g of divinylsuccinic acid and 200 g of dimethylformamide was heated to 70° C. under a nitrogen stream, and 1.5 g of A. I. B. N. was added thereto and reacted for 8 hours. The resulting reaction product was then subjected to reprecipitation in hexane and a solid product was collected by filtration, followed by drying to obtain 38 g of a powder.

Example 14

A mixture of 200 g of photoconductive zinc oxide, 40 g of (ethyl methacrylate/acrylic acid) copolymer (weight component ratio 97/3, weight average molecular weight 63,000), 1.5 g (as solid content) of the resin grains obtained in Preparation Example 1, 0.06 g of Rose Bengal, 0.20 g of phthalic anhydride and 300 g of toluene was ball milled for 2 hours. The thus resulting light-sensitive layer forming dispersion was applied to a paper rendered electrically conductive to give an adhered quantity on dry basis of 25 g/m$^2$ by a wire bar coater, followed by drying at 110° C. for 30 seconds. The thus coated paper was allowed to stand in a dark place at a temperature of 20° C. and a relative humidity of 65% for 24 hours to prepare an electrophotographic light-sensitive material.

Comparative Example 3

The procedure of Example 14 was repeated except not using 1.5 g (as solid content) of the resin grains obtained in Preparation Example 8 to prepare an electrophotographic light-sensitive material.

These light-sensitive materials were then subjected to evaluation of the electrostatic characteristics and reproduced image quality, in particular, under ambient conditions of 30° C. and 80% RH. Furthermore, when using these light-sensitive materials as master plate for offset printing, the oil-desensitivity of the photoconductive layer in terms of a contact angle of the photoconductive layer with water after oil-desensitization and the printing performance in terms of a stain resistance and printing durability.

The image quality and printing performance were evaluated using a lithographic printing plate obtained by subjecting the light-sensitive material to exposure and development by means of an automatic plate making machine, ELP 404 V using a developing agent, ELP-T to form an image and etching by means of an etching processor using an oil-desensitizing solution, ELP-E. As a printing machine, Hamada Star 800 SX was used.

The results are shown in Table 6:

TABLE 6

| | Example 14 | Comparative Example 3 |
|---|---|---|
| Electrostatic Characteristics | | |
| Vo (−V) | 580 | 555 |
| DRR (%) | 83 | 88 |
| $E_{1/10}$ (lux · sec) | 11.0 | 11.5 |
| Image Quality | | |
| I: (20° C., 65%) | good | good |
| II: (30° C., 80%) | good | good |
| Contact Angle with Water (degrees) | less than 5° | 40–50° large dispersion |
| Background stain | | |
| I | no | yes |
| II | no | marked |
| Printing Durability | no stain even after 10000 prints | marked background stain from printing start |

The characteristic items described in Table 6 are evaluated as described in the notes of Table 2.

As can be seen from Table 6, the light-sensitive material of the present invention exhibited excellent electrostatic characteristics of the photoconductive layer and gave a reproduced image free from background fog and excellent in image quality. This tells that the photoconductive material and binder resin are sufficiently combined and the added hydrophilic resin grains have no bad influences upon the electrostatic characteristics.

When the light-sensitive material of the present invention is used as a master plate for offset printing, the oil-desensitizing processing can well be accomplished by one passage through a processor even with a diluted oil-desensitizing solution and consequently, a non-image area is so rendered hydrophilic that the contact angle of the non-image area with water be smaller than 10°. Thus, it is found by observation of real prints that the printing plate precursor of the present invention can form a clear image and produce more than 10,000 clear prints without background stains.

In Comparative Example 3, on the other hand, the electrophotographic properties (image quality) were good, but in the oil-desensitizing processing as a master plate for offset printing, a non-image area was not sufficiently rendered hydrophilic, so that in real printing, background fog markedly occurred from the beginning in the print.

It will clearly be understood from these considerations that according to only the present invention, there can be obtained an electrophotographic photoreceptor capable of satisfying electrostatic properties as well as printing adaptability.

Examples 15 to 18

The procedure of Example 14 was repeated except using 1.5 g (as solid content) of each of the resin grains shown in Table 7 instead of the resin grains obtained in Preparation Example 8, thus obtaining each of electrophotographic light-sensitive materials.

These light-sensitive materials were subjected to the similar evaluations to Example 14 to obtain results as shown in Table 7:

TABLE 7

| Example | Hydrophilic Resin Grains | Image Quality | Contact Angle with Water | Number of Printing Durability |
|---|---|---|---|---|
| 15 | Preparation Example 9 | excellent in and II of Table 6 | 11° | more than 10,000 prints free from stains |
| 16 | Preparation Example 10 | excellent in and II of Table 6 | 9° | more than 10,000 prints free from stains |
| 17 | Preparation Example 11 | excellent in and II of Table 6 | 5° or less | more than 10,000 prints free from stains |
| 18 | Preparation Example 12 | excellent in and II of Table 6 | 5° or less | more than 10,000 prints free from stains |

As can be seen from the results of Table 7, the electrophotographic photoreceptor of the present invention has excellent electrophotographic properties and is capable of giving a number of clear prints free from background stain.

Example 19

A mixture of 10 g of the resin powder obtained by Preparation Example 16, 1.8 g of (dodecyl methacrylate/acrylic acid) copolymer (weight component ratio 95/5) and 100 g of toluene was dispersed for 56 hours in a ball mill to obtain a dispersion, i.e., latex with an average grain diameter of 0.40 μm.

A light-sensitive material was prepared in an analogous manner to Example 14 except using 1.5 g of the thus resulting resin grains (as solid content) and subjected to measurement of the electrostatic characteristics, image quality and printing properties. The image quality was good and the contact angle of non-image areas after etching with water was small, i.e. 6°. In printing, there was found no background stain from the start of printing, nor background stain even after printing 10,000 prints.

Examples 20 to 22

The procedure of Example 19 was repeated except using 10 g of each of the resin grains shown in the following Table 8 instead of the resin grains obtained in Preparation Example 16, thus obtaining each of light-sensitive materials.

TABLE 8

| Example | Resin Grains | Average Grain Diameter of Latex | Image quality | Number of Printing Durability |
|---|---|---|---|---|
| 20 | Preparation Example 13 | 0.35 μm | good | more than 10,000 prints free from stains |
| 21 | Preparation Example 14 | 0.41 μm | good | more than 10,000 prints free from stains |
| 22 | Preparation Example 15 | 0.33 μm | good | more than 10,000 prints free from |

TABLE 8-continued

| Example | Resin Grains | Average Grain Diameter of Latex | Image quality | Number of Printing Durability |
|---|---|---|---|---|
| | | | | stains |

These light-sensitive materials were subjected to measurement of the electrostatic characteristics and printing properties in the similar manner to Example 14, thus resulting in good results as shown in Table 8. In printing, in particular, there was found no background stains in a print even after printing 10,000 prints.

Examples 23 to 29

The procedure of Example 14 was repeated except using the same amount of each of resin powders shown in Table 9 instead of the resin grains obtained in Preparation Example 8, thus obtaining each of light-sensitive materials.

These light-sensitive materials were subjected to measurement of the electrostatic characteristics and printing properties in the similar manner to Example 14, thus obtaining good results as shown in Table 9. In printing, in particular, there was found no background stain in a print even after printing 10,000 prints.

TABLE 9

| Example | Resin Grains* | Main Component | Image Quality | Number of Printing Durability |
|---|---|---|---|---|
| 23 | Turfin P-20 (Kao KK) | Polyacrylic acid | good | more than 10,000 prints free from stains |
| 24 | KI Gel KI201K (Kurare Isoprene Chemical) | isobutylene/ maleic anhydride copolymer saponified | good | more than 10,000 prints free from stains |
| 25 | Sumika Gel SP-510 (Sumitomo Kagaku KK) | acrylic acid/ vinyl alcohol copolymer | good | more than 10,000 prints free from stains |
| 26 | Sumika Gel NP-1010 (Sumitomo Kagaku KK) | sodium poly-acrylate | good | more than 10,000 prints free from stains |
| 27 | Aquaprene L-710 (Meisei Kagaku KK) | polyethylene oxide | good | more than 10,000 prints free from stains |
| 28 | Sanwet IM-300 MPS (Sanyo Kasei KK) | starch poly-acrylate | good | more than 10,000 prints free from stains |
| 29 | G. P. C. (Grain Processing Co.) | starch/acrylo-nitrile copolymer saponified | good | more than 10,000 prints free from stains |

Note: *commercial name

As is evident from the results of these Examples, the hydrophilic resin of the present invention can sufficiently be dispersed in the form of desired fine particles even by a method comprising adding the hydrophilic resin in the form of a powder to a zinc oxide light-sensitive layer forming composition without previous formation of fine particles and then subjecting the resin powder containing composition to dispersing treatment in a ball mill.

According to the present invention, therefore, there can be provided a lithographic printing plate precursor with very excellent printing properties.

Since the hydrophilic resin grains of the present invention do not deteriorate the electrophotographic properties of the photoconductive layer, it is possible to effect formation of an image with a good image quality and to speed up the processings of from etching to printing.

The hydrophilic resin having a high order network structure according to the present invention has also the similar merits. Furthermore, this hydrophilic resin grains is insoluble or hardly soluble in water and is not dissolved out with moistening water during lithographic printing, so not only the number of prints can be increased, but also the lithographic printing plate can repeatedly be used in stable manner.

What is claimed is:

1. An electrophotographic lithographic printing plate precursor comprising an electrically conductive support and at least one photoconductive layer, provided thereon, containing photoconductive zinc oxide and a binder resin, in which said photoconductive layer contains hydrophilic resin grains having an average grain diameter of same as or smaller than the maximum grain diameter of said photoconductive zinc oxide grains.

2. The electrophotographic lithographic printing plate precursor as claimed in claim 1, wherein the hydrophilic resin has such a high order network structure that a film formed by dissolving the resin in a solvent and then coating has a contact angle with distilled water of at most 50 degrees.

3. The electrophotographic lithographic printing plate precursor as claimed in claim 1, wherein the hydrophilic resin grains have a maximum grain diameter of at most 10 μm and an average grain diameter of at most 1 μm.

4. The electrophotographic lithographic printing plate precursor as claimed in claim 1, wherein the hydrophilic resin grains are in a proportion of 0.1 to 5 parts by weight to 100 parts by weight of the photoconductive zinc oxide.

5. The electrophotographic lithographic printing plate precursor as claimed in claim 1, wherein the hydrophilic resin is selected from the group consisting of synthetic hydrophilic resins and natural hydrophilic resins.

6. The electrophotographic lithographic printing plate precursor as claimed in claim 1, wherein the hydrophilic resin consists of a homopolymer or copolymer comprising a polymeric component having at least one hydrophilic group in the polymer side chain, the polymeric component being in a proportion of 20 to 100% by weight to the resin.

7. The electrophotographic lithographic printing plate precursor as claimed in claim 2, wherein the high order network structure is formed by crosslinking the polymer molecule chains of a polymer comprising hydrophilic polymeric components.

8. The electrophotographic lithographic printing plate precursor as claimed in claim 2, wherein the hydrophilic resin has solubility of at most 80% by weight in water.

9. The electrophotographic lithographic printing plate precursor as claimed in claim 7, wherein the crosslinking is carried out by the use of a crosslinking agent or hardening agent.

10. The electrophotographic lithographic printing plate precursor as claimed in claim 7, wherein the crosslinking is carried out by polymerizing a monomer corresponding to the hydrophilic polymeric component in the presence of a multifunctional monomer or oligomer containing at least two polymerizable functional groups.

11. The electrophotographic lithographic printing plate precursor as claimed in claim 7, wherein the crosslinking is carried out by polymerizing or high molecular reaction of a polymer having reactive groups with the hydrophilic polymerizable component.

12. The electrophotographic lithographic printing plate precursor as claimed in claim 1, wherein the binder resin is at least one member selected from the group consisting of vinyl chloride/vinyl acetate copolymers, styrene/butadiene copolymers, styrene/methacrylate copolymers, methacrylate copolymers, acrylate copolymers, vinyl acetate copolymers, polyvinyl butyral, alkyd resins, silicone resins, epoxy resins, epoxy ester resins and polyester resins.

13. The electrophotographic lithographic printing plate precursor as claimed in claim 1, wherein the binder resin has a molecular weight of $10^3$ to $10^6$ and a glass transition point of $-10°$ C. to 120° C.

14. The electrophotographic lithographic printing plate precursor as claimed in claim 1, wherein the binder resin is in a proportion of 10 to 60 parts by weight to 100 parts by weight of the photoconductive zinc oxide.

15. The electrophotographic lithographic printing plate precursor as claimed in claim 1, wherein the photoconductive layer further contains at least one dye as a spectral sensitizer.

16. A process for forming an electrophotographic lithographic printing plate comprising the steps of forming an electrostatic latent image on an electrophotographic lithographic printing plate precursor, developing with a toner, fixing, and processing for rendering the non-image area(s) hydrophilic by oil-desensitization to produce a lithographic printing plate, wherein said electrophotographic lithographic printing plate precursor comprises an electrically conductive support having at least one photoconductive layer provided thereon, said photoconductive layer comprising photoconductive zinc oxide, a binder resin, and hydrophilic resin grains having an average grain diameter the same as or smaller than the maximum grain diameter of said photoconductive zinc oxide.

17. An electrophotographic lithographic printing plate precursor of the type in which non-image areas are rendered hydrophilic by oil-desensitization to produce a lithographic printing plate, wherein said electrophotographic printing plate precursor comprises an electrically conductive support having at least one photoconductive layer provided thereon, said photoconductive layer containing photoconductive zinc oxide, a binder resin and hydrophilic resin grains having an average grain diameter which is the same as or smaller than the maximum grain diameter of said photoconductive zinc oxide.

* * * * *